US011207699B2

(12) United States Patent
Davidson

(10) Patent No.: US 11,207,699 B2
(45) Date of Patent: Dec. 28, 2021

(54) SPRAY COATING CARRIAGE ASSEMBLY, APPARATUS INCLUDING THE ASSEMBLY

(71) Applicant: James W. Davidson, Hartville, OH (US)

(72) Inventor: James W. Davidson, Hartville, OH (US)

( * ) Notice: Subject to any disclaimer, the term of this patent is extended or adjusted under 35 U.S.C. 154(b) by 0 days.

(21) Appl. No.: 16/775,588

(22) Filed: Jan. 29, 2020

(65) Prior Publication Data

US 2020/0246815 A1 Aug. 6, 2020

Related U.S. Application Data

(60) Provisional application No. 62/800,675, filed on Feb. 4, 2019.

(51) Int. Cl.
*B05B 3/18* (2006.01)
*B05C 5/02* (2006.01)

(52) U.S. Cl.
CPC . *B05B 3/18* (2013.01); *B05C 5/02* (2013.01)

(58) Field of Classification Search
USPC ..... 118/300, 323, 321
See application file for complete search history.

(56) References Cited

U.S. PATENT DOCUMENTS

| | | | | |
|---|---|---|---|---|
| 1,648,504 | A * | 11/1927 | Offenbacher | C03C 17/10 118/56 |
| 3,040,381 | A | 6/1962 | Pioch | |
| 3,266,729 | A | 8/1966 | Baskett | |
| 3,379,377 | A | 4/1968 | Ripple | |
| 3,383,046 | A | 5/1968 | Veogtly | |
| 3,954,544 | A | 5/1976 | Hooker | |
| 3,985,161 | A | 10/1976 | Nelson | |
| 4,048,956 | A | 9/1977 | Estebanez et al. | |
| 4,253,607 | A | 2/1981 | Gerard, Sr. | |
| 4,402,459 | A | 9/1983 | Berry | |
| 5,109,791 | A | 5/1992 | Matsumoto et al. | |
| 5,670,178 | A | 9/1997 | West | |
| 6,024,147 | A | 2/2000 | Hunter, Jr. | |
| 6,036,123 | A | 3/2000 | West | |
| 6,090,203 | A | 7/2000 | Gebhardt et al. | |
| 6,358,344 | B1 | 3/2002 | Hunter, Jr. | |
| 6,981,157 | B2 | 12/2005 | Jakobsson | |
| 7,118,629 | B2 | 10/2006 | Davidson | |
| 8,561,571 | B2 * | 10/2013 | Shioi | B05B 12/04 118/686 |
| 2006/0005765 | A1 * | 1/2006 | Davidson | B05B 13/005 118/323 |

* cited by examiner

*Primary Examiner* — Yewebdar T Tadesse
(74) *Attorney, Agent, or Firm* — Hudak, Shunk & Farine Co. LPA

(57) ABSTRACT

A carriage assembly for a spray coating apparatus and a spray coating apparatus including the carriage assembly. The carriage assembly includes a carriage operatively connected to a track that is non-linear, which in some embodiments allows a coating to be applied at at least two different thicknesses.

19 Claims, 5 Drawing Sheets

SPRAY COATING CARRIAGE ASSEMBLY, APPARATUS INCLUDING THE ASSEMBLY

FIELD OF THE INVENTION

The present invention relates to a carriage assembly for a spray coating apparatus and a spray coating apparatus including the carriage assembly. The carriage assembly includes a carriage operatively connected to a track that is non-linear, which in some embodiments allows a coating to be applied at at least two different thicknesses.

BACKGROUND OF THE INVENTION

Spray coating devices have long been used to apply functional coatings, such as paints, stains, foams and the like to a substrate.

Depending upon the chemical composition of the material to be sprayed, the material may be of a single component or multi-component, the latter being formed from a composition including at least two components that must be separated to prevent premature curing.

U.S. Pat. No. 6,024,147 to Hunter, Jr. relates to a method and an industrial robotic device for reportedly uniformly applying coatings at appropriate thickness and pitch upon a surface that moves a spray applicator foam dispenser between two parallel tracks. The uniform application of foam at each pass is reportedly assured, by accelerating the speed of the foam dispenser at the end of each pass, by providing respective curved uphill distal ends of the tracks, so that the spray applicator foam dispenser moves up the curved distal ends and returns quickly while changing speed tilt and direction at the end of each pass.

U.S. Pat. No. 7,118,629 to Davidson relates to a device adapted to dispense or spray a coating such as a foam in a predetermined pattern or manner on a substrate, preferably a roof. The spray coating apparatus comprises a spray assembly having a carriage which is operatively mounted on a track that preferably provides a linear travel path. The carriage is controlled by a drive mechanism which causes reciprocating movement of the carriage. A spray gun is mounted on a holder of the carriage and controlled by an actuator and is used to uniformly apply coatings at a predetermined thickness controlled in part by a spray rate on the intended substrate. In one embodiment, the apparatus includes a cart which is either motorized or manual. The apparatus is lightweight and easily disassembled into sections in order to transport the device from a ground surface to a roof.

Although the prior art devices are suitable for applying a coating to a substrate, the art still needs a versatile device or apparatus that can apply single or multi-component coatings in a desired pattern onto a substrate, preferably while the apparatus is being moved over the substrate.

SUMMARY OF THE INVENTION

In view of the above, a spray coating apparatus that is adapted to accommodate and apply both single component coatings and multi-component coatings to a substrate is provided.

In various embodiments of the invention a portable spray coating apparatus is disclosed, comprising a wheeled frame or cart adapted to be guided along a surface or substrate. The apparatus can be moved manually or be equipped with a controllable drive mechanism including a motor or engine. A carriage assembly of the apparatus is operatively connected to the frame and includes a spray device. The carriage assembly reciprocates in a direction generally perpendicular to a defined travel path in a preferred embodiment.

In a further embodiment, the carriage assembly includes a carriage operatively mounted on a track having a non-linear guide path. In a preferred embodiment, the track has a first end section and a second end section that curve upwardly in relation to a central section of the track. This particular configuration permits the coating material to be applied to a substrate at a thickness that is less than a thickness applied to the substrate when the carriage is in a central section of the track. The structure of the carriage assembly including the end sections that curve upwardly allows a coating to be sprayed on an extended area of the substrate while reversing of the carriage takes place, thereby minimizing sudden impact or stopping of the carriage and preventing puddling or excessive build-up at the end of the spray path that would otherwise occur. The configuration and spray path produces a uniform, thinner area of coating that can either be applied over a coating applied previously, e.g. as an overlapping section, or as a base layer that can be top coated by an adjacent overlapping coating applied during a subsequent pass of the device.

In yet another embodiment of the present invention, the carriage has a drive mechanism having a drive member that moves or reciprocates the carriage along a drive path. The drive path of the drive member is preferably substantially linear or linear and has a configuration that is different from the guide path of the carriage track.

In still a further embodiment, the carriage assembly is configured such that the carriage travels along the path of the carriage track which deviates, preferably by curving upwardly and away, from the path of the drive member during use, wherein the drive member remains operatively connected to the carriage during operation.

In a further embodiment, in order to accomplish desired movement of the carriage along the carriage track, the carriage is provided with a socket mated with the carriage drive member. The socket is larger in size than the drive member and preferably is formed as a slot, groove or channel such that the drive member is moveable therein. In a preferred embodiment, the socket has a longitudinal axis that is oriented vertically or substantially vertically and the drive member is moveable up and down within the socket depending upon the position of the carriage on the track.

For the avoidance of doubt, it is to be understood that while various embodiments of the invention are described individually, it should be clear two or more of the embodiments can and are often present in a single apparatus according to the invention.

BRIEF DESCRIPTION OF THE DRAWINGS

The present invention is described in connection with the examples of preferred embodiments represented in the annexed drawings, in which.

DETAILED DESCRIPTION OF THE INVENTION

Figure 1:
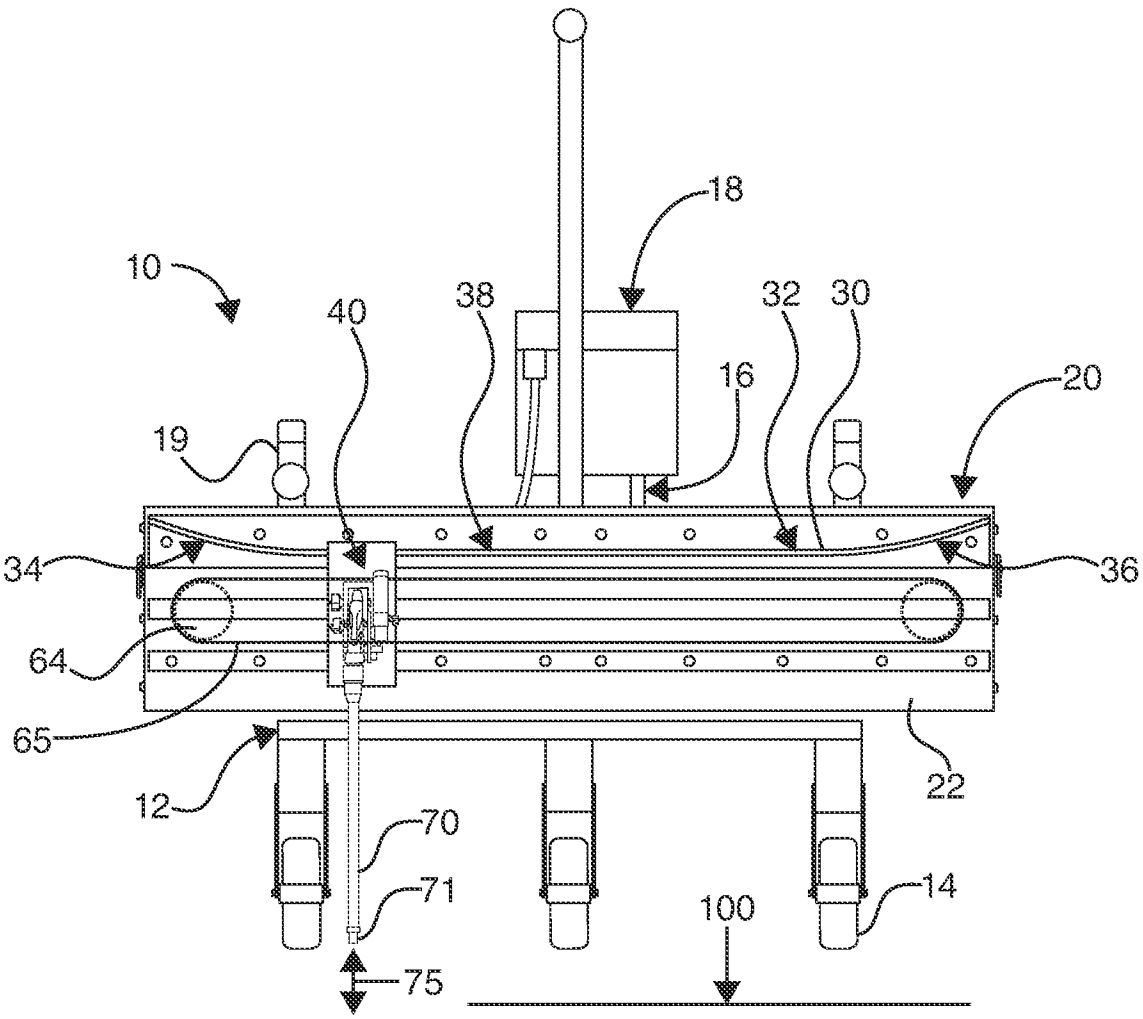
FIG. 1 illustrates a front elevational view of one embodiment of an apparatus of the present invention for applying a coating to a substrate, wherein the apparatus includes a carriage assembly having a carriage operatively mounted on a track that is non-linear.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "upper", "down," "lower", "top", "bottom", as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The carriage assembly of the present invention is especially adapted for a spray coating apparatus able to apply one or more coatings to a substrate. The spray coating apparatus can advantageously apply single component coatings and multiple component coating to a substrate. Various different types of coatings can be utilized as known in the art, for example, but not limited to, paint, protective finishes, and intermediate layers containing compounds that can be spray applied or broadcast such as but not limited to polyurethane resins, such as expanding polyurethane foam of either one or two components, silicone resins, and acrylic resins at a desired thickness on a substrate, such as a roof of a building. The spray coatings can be applied on surfaces that are horizontal, either overhead or underfoot, vertical, or at generally any angle.

The construction of the carriage assembly allows application of a coating having a variable film thickness along a spray path. Preferably in one embodiment, the carriage assembly allows the spray coating apparatus to apply a coating to a substrate having a first thickness at a central portion of a spray path that is greater than a thickness at a second portion of a spray path located outwardly from the central portion of the track. The variation in film thickness is provided by the carriage assembly which includes a floating carriage on which a spray applicator is mounted.

Referring now to the drawings, wherein like parts or components are represented by like or identical reference numbers throughout the several views, FIG. 1 illustrates one embodiment of a spray coating apparatus 10 which includes a frame 12 that supports a carriage assembly 20. Configuration of frame 12 can vary according to type of substrate the spray coating apparatus 10 is designed to apply a coating upon.

The frame 12 in one embodiment has a primary purpose of providing mobility to the carriage assembly which accommodates spray applicator 70 in order to coat preferably stationary substrates. In the embodiment illustrated, the frame is provided with wheels 14, at least one of which is operatively driven by drive mechanism 16. Drive mechanism 16 can comprise any drive elements such as a motor, engine or the like, operatively connected via suitable linkage, such as a chain, belt, axle, spindle or the like to at least one wheel for manipulating the spray coating apparatus 10 across a substrate 100. Drive mechanism 16 can be operated utilizing a control unit 18 and can include steering controls which through suitable linkage allow one or more wheels to be turned or manipulated and thus control the direction of movement or travel of spray coating apparatus 10 having carriage assembly 20 thereon.

In one embodiment, the frame can be moved manually. In such cases, the apparatus 10 can include one or more caster wheels in order to provide steering or direction change to the frame.

In a preferred embodiment, one or more portions of the carriage assembly 20 are adjustable in relation to frame 12 such that the height of the carriage assembly in relation to a substrate 100 can be varied. A height adjustment device 19 is provided in one embodiment. The height adjustment device can be a manually operated device such as a jack. In other embodiments the height adjustment can be controlled electronically.

The frame can be constructed from any combination of durable material such as metal, polymers, and wood, with metal highly preferred. Metal tubing and/or bar stock such as square or angle bars are utilized in some embodiments.

The spray coating apparatus 10 control unit 18 is connected to a suitable power source, such as a fixed or portable-mounted power generator or a power grid such as through an electrical extension cord. The control unit 18 is operatively connected to the frame at a location where the user can operate the apparatus 10. Control unit 18 preferably comprises a device for control of the speed of carriage assembly 20, a device for control of an amount of coating dispensed per unit of time, a device for control of the speed and/or direction of the spray coating apparatus 10, a spray applicator activating device or any combination thereof. Control devices can comprise switches, rheostats or the like as known to those of ordinary skill in the art. Remote or wireless controls can also be utilized, if desired.

In a preferred embodiment, the control unit 18 is configured or programmed in order to control all desired functions of the spray coating apparatus 10 individually and/or simultaneously as desired.

Spray coating apparatus 10 allows a user to control movement of the apparatus along substrate 100 as well as application of coating from spray applicator 70, operatively connected to carriage assembly 20. In operation, generally the apparatus is moved forward in the direction from the rear of the frame towards the carriage assembly 20 following a path controlled by the position of the wheels with a coating dispensed downwardly and/or outwardly from the spray applicator 70.

The carriage assembly 20 is connected to the spray coating apparatus 10 so that spray nozzle 71 of spray applicator 70 operatively connected the carriage assembly 20 is located at a desired vertical distance from substrate 100, such as shown in the front view of FIG. 1.

Figure 3:
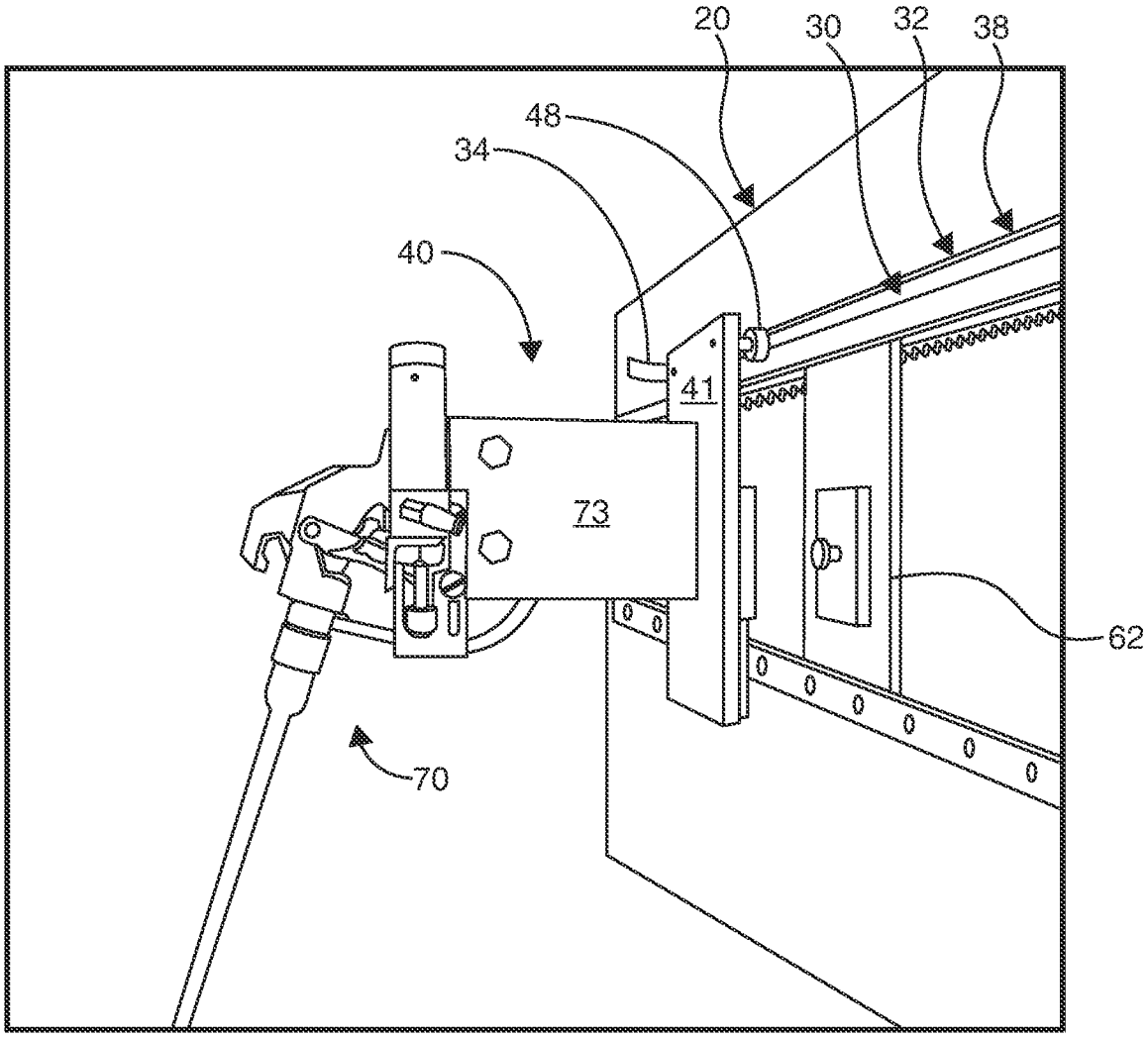
FIG. 3 is a detailed view showing that the carriage can be disengaged from the drive member in order to be removed from the track.

Carriage assembly 20 includes a housing 22 which operatively connects the assembly to frame 12. Housing 22 is generally elongated or rectangular and includes a first end and a second end. Track 30 is connected to housing 22, preferably on a front face thereof as illustrated in FIGS. 1 and 3. Track 30 includes a guide path 32 along which carriage 40 travels, as described further herein.

In one embodiment, the track guide path 32 has a central section 38 that is substantially horizontal or linear and a first end section 34 and a second end section 36 that each curve upwardly in relation to the central section 38. The track guide path 32 curves upwardly at each end so that the material can be sprayed up to an angle of about 90° from vertical, and preferably up to 45° from vertical. However, the carriage may be configured to spray up to any angle between 5° up to 45° or 90° from vertical as desired for a particular coating, substrate or structure.

Figure 2:
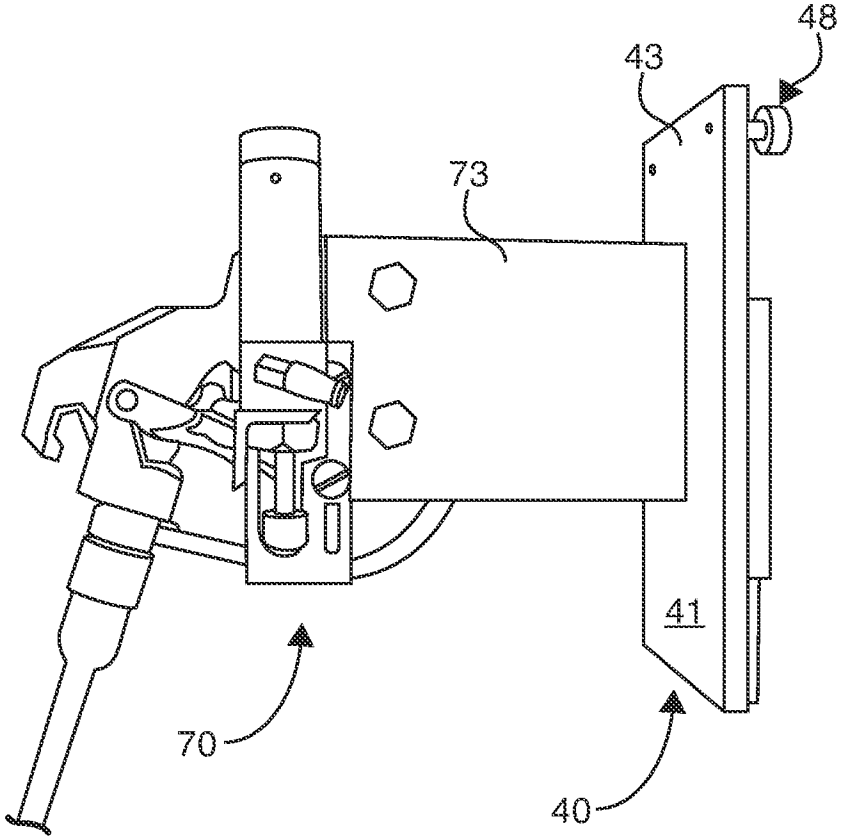
FIG. 2 is a detailed view showing the carriage.

The track comprises two or more rails, such as an upper rail and a lower rail having a groove or channel formed therebetween. The groove or channel can be considered as having a T-shape, see FIG. 5, although other shapes can be utilized. The length of the guide path can vary, depending upon the size of the spray coating apparatus 10. As shown in FIG. 1, carriage 40 is operatively connected to track 30 for lateral movement back and forth between the ends of track 30. Carriage 40 includes a base 41, see FIG. 2, that serves as a connection point for many of the components of carriage 40. A spray applicator 70 is operatively connected to a front or outer surface of base 41 through spray arm 73. The spray arm is constructed to hold and maintain spray applicator 70 in a predetermined position or angle with respect to horizontal or a surface of the substrate to be coated. In one embodiment connection is provided by a milled back plate containing threaded studs and a strap clamp machine to universally accommodate a wide range of dispensing mechanisms.

Carriage 40 includes a guide member 48 operatively connected to base 41. The guide member 48 travels along the guide path 32 of track 30. The guide members 48 interact with track 30 such that the carriage travels along the guide path 32 back and forth between the ends of the track 30. Guide members 48 are constructed as, but not limited to, wheels, bearings, or other low friction slide elements comprising for example Teflon®, Viton® and/or ultrahigh molecular weight polymer, that allow the guide member 48 to travel along track 30 when the carriage 40 is manipulated by drive mechanism 60. The guide member 48 can be operatively connected to the track, such as by sliding the guide member into the guide path 32 from either end of the track. Due to the structure of guide path 32, one can see that as carriage 40 traverses track 30, the carriage is moved upwardly and at an angle towards the outer ends of the first end section 32 and second end section 36 of track 30.

In one embodiment, a suitable drive mechanism for carriage 40 is set forth in U.S. Pat. No. 7,118,629, herein fully incorporated by reference. However, it is to be understood that other drive mechanisms can be utilized, provided the desired function of the carriage assembly is maintained.

Figure 5:
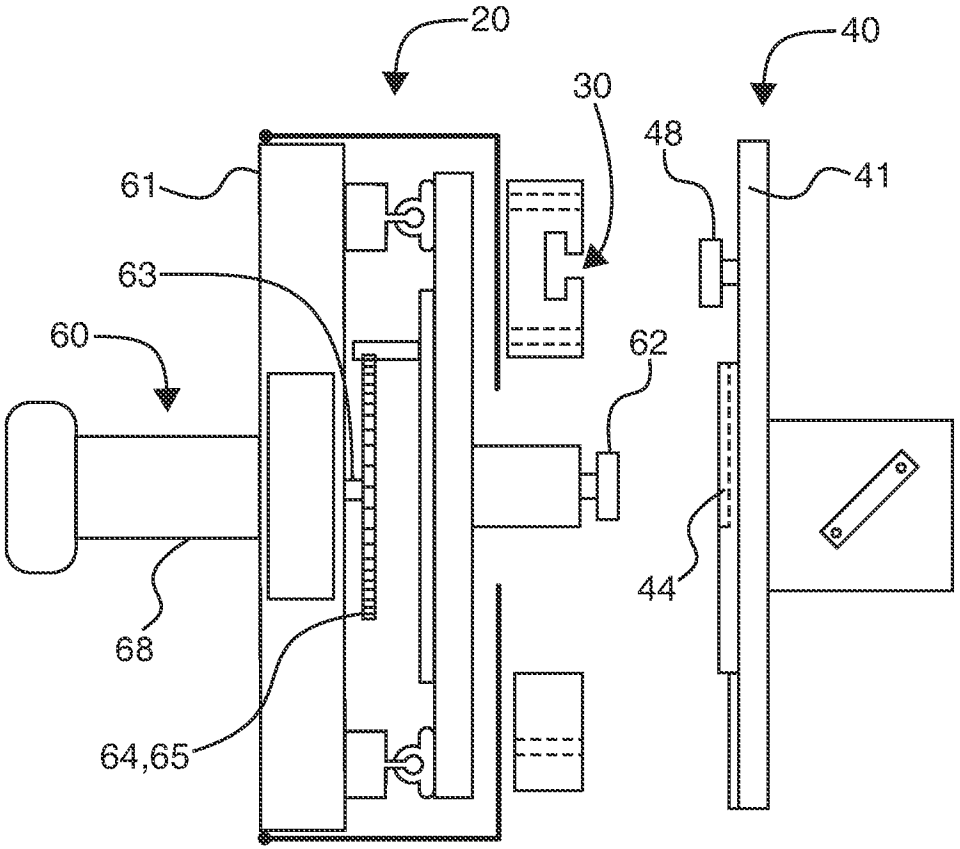
FIG. 5 is an exploded, side elevational view of the embodiment shown in FIG. 1.

Turning now to the continuous drive mechanism 60 of the carriage 40, the mechanism is shown in FIG. 5 and is utilized to reciprocate the carriage 40 and spray applicator 70 connected thereto in order to apply a coating to an intended substrate in a predetermined pattern and thickness. Housing 22 of carriage assembly 20 includes a back plate 61 which is fixedly connected to the apparatus frame 12 directly r indirectly through another stationary portion of housing such as a housing base. Back plate 61 serves as a fixed foundation to which the continuous drive mechanism is attached. A motor 68 is operatively connected to housing back plate 61 so that at least rotatable motor shaft 63 thereof extends into the housing. The motor housing can be attached to frame. A sprocket 64 is connected to the motor shaft and is suitably constructed with teeth or the like in order to manipulate or rotate continuous drive chain or belt loop 65. A drive chain loop 65 is connected at a second end around sprocket 64 which is fixed to a first axle which is journaled and rotatable in bearings attached to back plate and floating plate. An additional sprocket 64 is also fixedly attached to the first axle and has one end of the drive chain loop threaded therearound. A second rotatable axle is spaced a predetermined distance from the first axle and is operatively connected to the other end of drive chain via sprocket 64. The second axle is rotatably connected to back plate and front plate via bearings. Alternatively, the axles can be fixed and the sprockets rotatable on the axle through bearings. In one embodiment, a chain guide is provided to maintain desired alignment of the endless chain between sprockets. The spacing between axles is set such that the desired carriage travel distance and/or chain tension is achieved. In one embodiment, a chain tensioner is provided to maintain a predetermined chain tension. Accordingly, whenever motor 68 is activated, the endless chain rotates around the sprockets 654 on axles and has a generally oblong or oval path.

Figure 4:
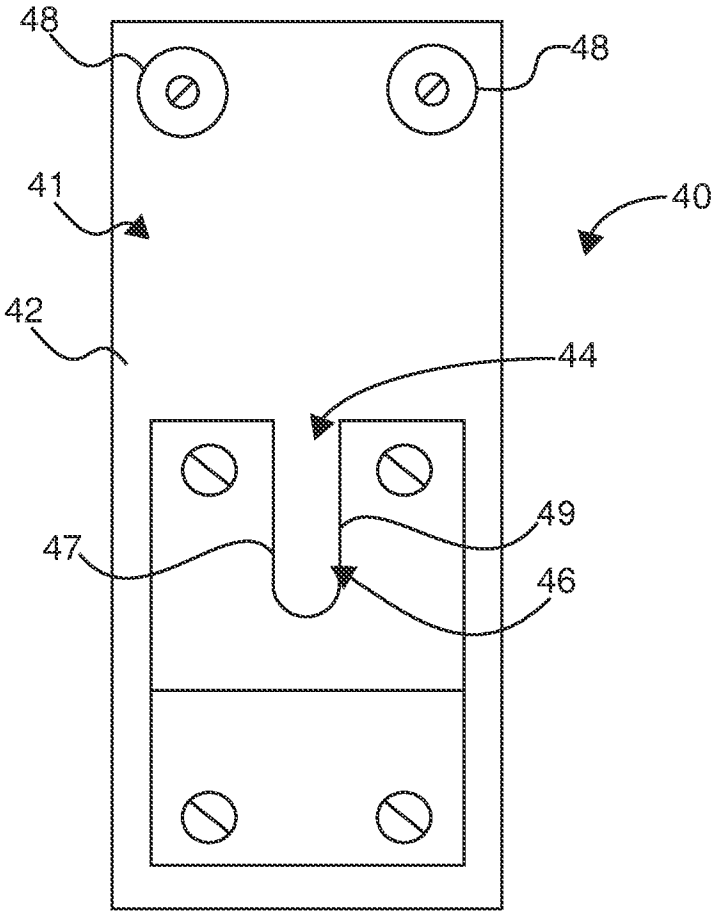
FIG. 4 is a rear view of the carriage particularly illustrating the socket which is mateable with the drive member and guide elements which mate with the track of the apparatus.

In order to reciprocally drive carriage 40 including spray applicator 70, the drive mechanism 60 is operatively connected to the carriage 40 via drive member 62 that reciprocates along a substantially linear drive path, preferably a horizontal drive path in one embodiment. To accomplish movement of carriage 40, the rear surface 42 of base 41 includes a socket 44 which mates with drive member 62, see FIG. 4. The socket 44 is preferably in the form of a vertically or substantially vertically oriented slot 46 that has a length, i.e. maximum vertical length, greater than that of drive member 62. The operative connection between drive member 62 and slot 46 allows the carriage to essentially float in relation to the drive mechanism 60 as the carriage 40 traverses track 30.

A portion of drive member 62 fits into and mates with socket 44 for driving carriage 40. Socket 44 slot 46 includes a first bearing surface 47 and a second bearing surface 49 where the first bearing surface 47 is contacted by drive member 62 when the drive member 62 is moving along the drive path in a first direction and the second bearing surface contacts the drive member 62 when the drive member is moving along the drive path in a second, opposite direction. Drive member 62 contacts the first bearing surface or the second bearing surface at a plurality of different vertical heights as the carriage is moved along the guide path due to the guide member 48 traversing guide path 32 of track 30. For example, as carriage 40 travels outwardly from central section 38 of track 30 and into the first end section 34, the upward curve of the guide path 32 lifts carriage 40, which causes the drive member 62 to travel downwardly in socket 44 until a desired end point is reached at the end of the guide path 32. As the carriage changes direction, carriage 40 is lowered in vertical height and drive member 62 contacts the bearing surface in socket 44 at a higher vertical height.

When carriage 40 is in central section 38 of the guide path 32, primary spray axis 75 can be considered a vertical axis. As the carriage travels into the first end section 34 and second end section 36 of the guide path, the carriage has an angled orientation, causing the primary spray axis to change from the vertical axis to a maximum angle of about 90° and preferably 45° measured from a vertical axis.

For the avoidance of doubt, the spray device and carriage assembly of the present invention encompass all possible combinations of the components, including various ranges of said components, disclosed herein. It is further noted that the term "comprising" does not exclude the presence of other elements. However, it is to also be understood that a description of a product comprising certain components also discloses a product consisting of said components. Similarly, it is also to be understood that a description of a process comprising certain steps also discloses a process consisting of the steps.

In accordance with the patent statues, the best mode and preferred embodiments have been set forth, the scope of the invention is not limited thereto, but rather by the scope of the attached claims.

What is claimed is:

1. A carriage assembly, comprising:

a drive member having a drive member drive path that is substantially linear;

a track having a track guide path that is non-linear, the track guide path being different than the drive member drive path;

a carriage having a base and a guide member operatively connected to the base, wherein the guide member travels along the track guide path, wherein the drive member is operatively connected to the carriage and reciprocates the carriage along the track guide path when the drive member traverses the drive member drive path, and wherein the carriage has a primary spray axis that changes between a vertical axis and a non-vertical axis as the carriage guide member travels along the track guide path.

2. The carriage assembly according to claim 1, wherein the track guide path of the track has a central section that is substantially horizontal and a first end section and second end section that each curve upwardly in relation the central section.

3. The carriage assembly according to claim 2, wherein the drive member drive path is substantially horizontal.

4. The carriage assembly according to claim 2, wherein the primary spray axis of the carriage is changeable from the vertical axis to an angle of about 45° measured from the vertical axis.

5. The carriage assembly according to claim 2, wherein the carriage includes a socket connected to the base, wherein a portion of the drive member fits into the socket for driving the carriage.

6. The carriage assembly according to claim 5, wherein the socket includes a vertically oriented slot having a first bearing surface and a second bearing surface each located on a separate vertical wall of the vertically oriented slot, with the first bearing surface contacted by the drive member when the drive member is moving along the drive member drive path in a first direction and the second bearing surface contacted by the drive member when the drive member is moving along the drive member drive path in a second direction.

7. The carriage assembly according to claim 6, wherein the drive member contacts the first bearing surface and the second bearing surface at a plurality of different vertical heights as the carriage is moved along the track guide path.

8. The carriage assembly according to claim 1, wherein the carriage includes a spray arm connected to the base and is configured to have a spray device connected thereto.

9. The carriage assembly according to claim 8, wherein the guide member is on a back surface of the base and the spray arm is on a front surface of the base, and wherein the guide member comprises a bearing.

10. A spray coating apparatus comprising the carriage assembly according to claim 1, connected to a frame comprising wheels for moving the carriage assembly along a substrate.

11. A carriage assembly, comprising:

a drive member operatively driven by a motor and reciprocated along having a substantially horizontal drive member drive path, wherein the drive member reciprocates a carriage along a guide path of a track of a carriage assembly;

the carriage comprising:

a base, a guide member connected to the base and configured to travel along the guide path of the track of the carriage assembly, a socket connected to the base, the socket including a slot having a first bearing surface and a second bearing surface, each of the first bearing surface and the second bearing surface configured to be contacted by the drive member of the carriage assembly, wherein the first bearing surface is configured to be contacted by the drive member when the drive member is moved along a drive path in a first direction and the second bearing surface is configured to be contacted by the drive member when the drive member is moved along the drive member drive path in a second direction, wherein the drive member is configured to contact each of the first bearing surface and the second bearing surface at a plurality of different vertical heights; and a spray arm connected to the base and configured to have a spray device connected thereto.

12. The carriage assembly according to claim 11, wherein the track has a track guide path that is non-linear, the track guide path being different than the drive member drive path, and wherein the carriage has a primary spray axis that changes as the guide member travels along the track guide path.

13. The carriage assembly according to claim 12, wherein the drive member is operatively connected to the carriage and reciprocates the carriage along the track guide path when the drive member traverses the drive member drive path.

14. The carriage assembly according to claim 13, wherein the track guide path has a central section that is substantially horizontal and a first end section and second end section that each curve upwardly in relation the central section.

15. The carriage assembly according to claim 14, wherein the drive member drive path is substantially horizontal.

16. The carriage assembly according to claim 15, wherein the primary spray axis of the carriage is changeable from the vertical axis to an angle of about 45° measured from the vertical axis.

17. The carriage assembly according to claim 16, wherein the guide member is on a back surface of the base and the spray arm is on a front surface of the base, and wherein the guide member comprises a bearing.

18. The spray coating apparatus comprising the carriage assembly according to claim 17, connected to a frame comprising wheels for moving the carriage assembly along a substrate.

19. A spray coating apparatus comprising the carriage assembly according to claim 11, connected to a frame comprising wheels for moving the carriage assembly along a substrate.

* * * * *